United States Patent [19]

Koslowski et al.

[11] Patent Number: 4,876,965

[45] Date of Patent: Oct. 31, 1989

[54] DEVICE FOR THE CENTERING OF A RAIL IN ELEVATOR STATIONS OF ELECTRIC OVERHEAD TROLLEY CONVEYORS

[75] Inventors: Gunter Koslowski, Soyen; Georg Uttscheid, Rosenheim, both of Fed. Rep. of Germany

[73] Assignee: ROFA Rosenheimer Förderanlagen GmbH, Fed. Rep. of Germany

[21] Appl. No.: 175,102

[22] Filed: Mar. 30, 1988

[30] Foreign Application Priority Data

Apr. 2, 1987 [DE] Fed. Rep. of Germany ..... 3711043

[51] Int. Cl.[4] ..... B66B 17/18

[52] U.S. Cl. ..... 104/127; 104/129

[58] Field of Search ..... 104/127, 128, 129; 187/32, 33, 76

[56] References Cited

U.S. PATENT DOCUMENTS 839,024 12/1906 Nelson ..... 104/129
1,905,571 4/1933 Smith ..... 104/129
3,611,946 10/1971 Heximer ..... 104/129
4,706,782 11/1987 Spoeler et al. ..... 104/127

FOREIGN PATENT DOCUMENTS 2319614 5/1979 Fed. Rep. of Germany .

*Primary Examiner*—Sherman D. Basinger
*Assistant Examiner*—Stephen P. Avila
*Attorney, Agent, or Firm*—Cahill, Sutton & Thomas

[57] ABSTRACT

The present invention refers to a device for the centering of a movable rail section relative to a stationary rail section of an overhead trolley conveyor, notably a lifting station of a trolley conveyor. There is at least one centering body attached to the stationary or to the movable rail section. The centering body has a recess. At the movable rail section and at the stationary rail section, respectively, a centering piece is provided which can be moved into the recess. The centering piece can be rotated within the recess about an axis which extends in the direction of the rail so that it comes into engagement with at least one of the walls of the recess.

2 Claims, 1 Drawing Sheet

DEVICE FOR THE CENTERING OF A RAIL IN ELEVATOR STATIONS OF ELECTRIC OVERHEAD TROLLEY CONVEYORS

The invention refers to a device for centering a rail in elevator stations of electric overhead trolley conveyors.

German patent application No. 23 19 614 describes a locking and centering device for overhead trolley conveyors whereby the rails are movable in the transverse direction.

For the centering of vertically movable rails, several approaches have been known:

(a) The rail of the elevator station is lifted beyond the proper position whereafter a resting pin is pivoted, whereupon the rail is lowered so that the pin comes to rest in the centering bearing;

(b) The rail is lifted beyond the proper position whereafter a centering pin is extended in the direction of the rail extension, whereupon the rail is lowered so that the pin comes to rest in the centering bearing;

(c) A cone-shaped centering pin is extended in the longitudinal direction of the rail so that it engages a corresponding recess.

In the approaches (a) and (b), an excess lift movement is necessary which requires complicated controls and additional time.

The approach (c) involves high horizontal forces for moving the cone-shaped centering pins in the direction of the rail if, in the course of this movement, a displacement in the vertical direction must be eliminated. Such horizontal forces require an increased strength of the construction and of the centering block.

It is an object of the present invention to provide a centering device which allows a rapid centering with simple control means, whereby high horizontal forces in the direction of the rail are avoided.

This problem is solved by the device of claim 1.

The invention will now be explained with reference to drawings.

Figure 2:
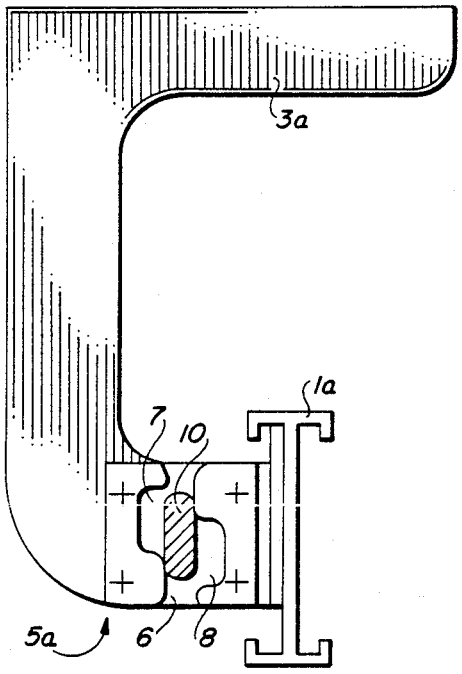
FIG. 2 shows a cross-section along line 2—2 of FIG. 1 in first working position.
Figure 3:
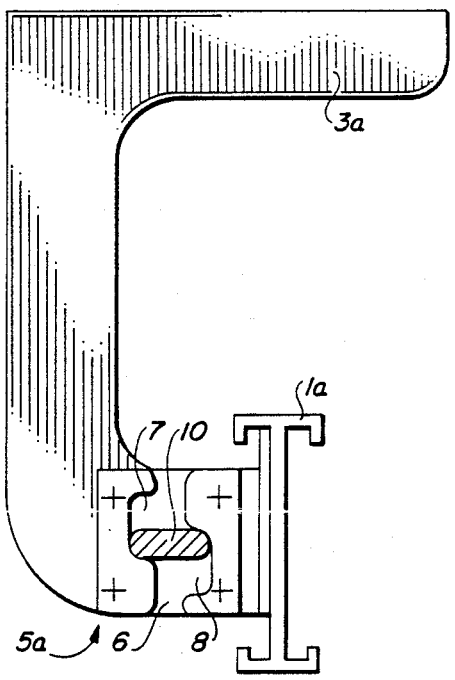
FIG. 3 shows a cross-section along line 2—2 of FIG. 1 in a second working position.

A preferred embodiment will now be described with reference to these FIGS. 1 to 3.

The trolley conveyor comprises a rail 1*a*, 1*b*, which is connected to a steel construction 2*a*, 2*b* by means of brackets 3*a*, 3*b*. FIGS. 2 and 3 show that the rails have a double-T cross-sectional shape. However, other conventional rail cross-sections can be employed.

Figure 1:
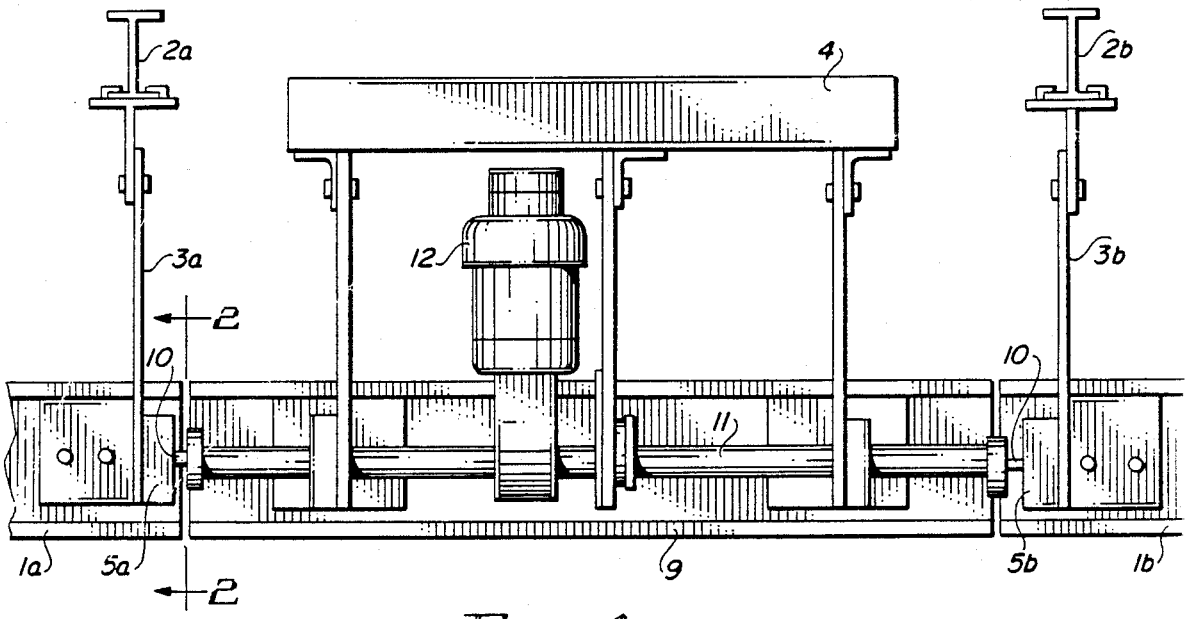
FIG. 1 shows a front elevation view of an embodiment of the centering device of the invention.

The elevator station shown in FIG. 1 is required in cases where there is no sufficient space for a sloped rail.

The elevator station comprises a rail segment 9 connected to a carrier 4. This carrier 4 can be moved in the vertical direction by conventional means which are not shown in FIG. 1. A trolley which has been moved onto this rail segment 9 can be moved from one level to another level by the vertical movement of the rail segment, which is attached to the carrier 4.

In each level, the rails 1*a*, 1*b* have open ends and the rail segment 9 of the elevator station must be centered with respect to these rails 1*a*, 1*b* so that the trolleys can be moved from the rail 1*a* onto the rail segment 9 or from the rail segment 9 onto the rail 1*b*. This raises the problem that the movable segment 9 must be positioned precisely with respect to the rails 1*a*, 1*b* in the vertical and in the transverse direction in order to enable a safe and smooth transfer of the trolley.

FIG. 1 shows only the rails 1*a*, 1*b* in one level, but not in the other levels.

In the preferred embodiment, each bracket 3*a*, 3*b* carries a centering block 5*a*, 5*b* at the side facing the movable rail segment 9 and in a proper spacing from the movable rail segment 9. Each of these centering blocks 5*a*, 5*b* comprises a slot 6 which extends in the vertical direction and which faces the movable rail segment 9. Each slot 6 has two recesses 7, 8. The slot 6 is slanted at its ends. The lateral recesses 7, 8 are facing each other, but with a displacement in the vertical direction so that the recess 8 close to the rail 1*a* has a lower position than the recess 7 at the side facing away from the rail 1*a*. The two recesses 7, 8 overlap in the vertical direction. They have flat sides and rounded shoulders. The centering block 5*a* can consist of one piece, whereby the slot 6 and the recesses 7, 8 are provided by milling or the like. However, it is advantageous to use a centering block 5*a* consisting of two individual parts which are attached to the bracket 3*a* in a proper relative position to each other, for example by bolts or by welding. This has the additional advantage that the two parts can have the same shape, since the centering block 5*a* has a symmetry axis.

The other centering block 5*b* connected with the rail 1*b* is a mirror image of the centering block 5*a* so that the recess at the side of the rail 1*b* is lower than the recess at the side facing away from the rail 1*b*.

Centering blocks 5*a*, 5*b* which are made of two individual parts have the additional advantage that the two centering blocks 5*a*, 5*b* can be made of the same individual parts.

The carrier 4 comprises a rotatable shaft 11 which extends parallel to the rail segment 9 and at the outside of this rail segment. An electric motor 12 with a reduction gearing, which is connected to the carrier 4, serves for turning the shaft 11. Other drive mechanisms can also be used.

Both ends of the shaft 11 are provided with centering pieces 10. FIGS. 2 and 3 show the centering piece in cross-section. In its cross-sectional shape, it has flat side surfaces and rounded ends.

The centering pieces 10 can be rotated about the center axis by means of the shaft 11. Their length and their position are chosen such that they extend into the centering blocks after the carrier 4 has been moved into the proper elevation, as shown in FIG. 1.

We turn now to the operation of this centering device. In the centered state, as shown in FIGS. 1 and 3, the centering pieces 10 engage the flat side surfaces of the recesses 7, 8 as well as the shoulders so that an exact positioning in the horizontal direction, i.e. traverse to the direction of the rail, is obtained. Further, the centering piece 10 engages the upper shoulder of the lower recess 8 and the lower shoulder of the upper recess 7 so that it is also positioned exactly in the vertical direction, as shown in FIG. 3.

Before the carrier 4 can be lifted into a different level, the centering mechanism must be unlocked. For this purpose, the centering piece shown in FIG. 3 must be rotated by 90° in the clockwise direction so that it acquires the position shown in FIG. 2. Now the centering piece 10 has a vertical orientation and the carrier 4 can be moved upward or downward, since the centering piece 10 is now freely movable within the slot 6. Now the carrier 4 is moved to a different floor. The centering piece 10 still has the vertical position so that it can enter the slot 6 of the centering block. The slanted ends of the slot 6 facilitate this movement even in case of a displacement in the horizontal direction. After the carrier 4 has approximately reached its proper position, it is stopped. For obtaining a precise centering of the rail, the centering piece 10 is rotated by 90° in the counterclockwise direction. Now its narrow sides engage again the side surfaces of the recesses 7, 8 and simultaneously the rounded portions of the centering piece 10 engage the upper shoulder of the lower recess 8 and the lower shoulder of the upper recess 7. As soon as the centering piece 10 has reaches its proper turning position, the rail segment 9 is also properly centered relative to the rails 1*a*, 1*b*. In the course of this operation, a displacement by several mm can be eliminated.

The nature of the movements during this operation is decisive for the dimensions of the recesses 7, 8. They overlap by a distance which is equal to the width of the centering piece 10 and the distance between the side surfaces of the two recesses 7, 8 must be equal to the length of the centering piece 10. The length of the recesses 7, 8 in the vertical direction must be sufficient for allowing a turning of the centering piece 10 even in the case of the greatest possible displacement.

It is a special advantage of this embodiment that the same type of centering by means of the centering body 5*b* takes place simultaneously at the other end of the movable rail segment 9.

In the above-described embodiment, the centering piece 10 is entered into the centering body 5*a* through a slot 6 extending in the vertical direction. Alternatively, the centering piece may be moved into the centering body 5*a* by a transverse movement. If only a positioning with respect to one axis is desired, the recesses within the centering bodies can be simpler. It may be sufficient to provide a centering device only at one end of the movable rail segment 9.

In an alternative embodiment, the centering bodies may be attached to the ends of the movable rail segment 9, whereas the turnable centering pieces are attached to the rails 1*a*, 1*b*.

The centering device of the present invention has been described in connection with a vertically movable rail segment. It may also be used in connection with a horizontally movable rail segment.

We claim:

1. A device for centering a moveable rail section relative to a stationary rail section in a lift station of a trolley conveyor comprising, a centering body attached to one of said rail sections, a centering piece attached to the other of said rail sections, said centering body having a generally vertically disposed slot therein permitting entry of said centering piece from above and below said body, said slot having oppositely disposed lateral cavities in the sidewalls thereof, said cavities being vertically displaced with respect to each other with an upper region of one cavity overlapping a lower region of the other cavity, said centering piece having an oblong cross-section and being rotatable about a central axis, the relationship between the centering body and the centering piece being such that when said centering piece is rotated to a position in which its longer dimension is disposed generally upright the centering piece can enter the slot in said centering body and when said centering piece is rotated to a position in which its longer dimension is disposed generally horizontally the centering piece occupies substantially entirely the overlapping regions of said cavities, the arrangement being such that rotation of said centering body to its horizontal position cams said moveable rail section into alignment with said stationary rail section regardless of the direction of initial displacement of said moveable rail section.

2. The device of claim 1 further characterized in that the moveable rail section has opposite ends, a pair of centering pieces mounted, respectively, on the ends of said moveable rail section and means including a common shaft for rotating said centering pieces.

* * * * *